United States Patent [19]

Boomer

[11] Patent Number: 4,575,091

[45] Date of Patent: Mar. 11, 1986

[54] WORD GAME OF MAGNETIZABLE LETTERS FOR CHILDREN

[76] Inventor: Mark J. Boomer, 15825-29 Mile Rd., Romeo, Mich. 48065

[21] Appl. No.: 656,684

[22] Filed: Oct. 1, 1984

[51] Int. Cl.[4] ..... A63F 9/00

[52] U.S. Cl. ..... 273/199; 434/168; 434/172

[58] Field of Search ..... 273/1 R, 1 G, 1 GG, 273/1 GD, 1 M, 239, 272; 434/167, 168, 172; 40/621

[56] References Cited

U.S. PATENT DOCUMENTS

| | | | |
|---|---|---|---|
| 606,744 | 7/1898 | St. John | 273/1 GD X |
| 1,009,421 | 11/1911 | Lankler | 434/172 |
| 1,509,873 | 9/1924 | Ordway | 273/1 GD |
| 2,474,447 | 6/1949 | Wheelock | 434/172 |
| 2,935,936 | 5/1960 | Woodring et al. | 40/621 X |
| 3,010,228 | 11/1961 | Torre | 434/168 |
| 3,122,684 | 2/1964 | Genin | 434/168 U X |
| 3,674,264 | 7/1972 | Boercker | 273/1 G |
| 3,853,321 | 12/1974 | Claffie | 273/1 GD X |

OTHER PUBLICATIONS

Playthings 5-1972, p. 37, Leapin' Letters.

Cleo Learning Aids Catalog, 2/28/1976, p. 172, Alphabet Game.

*Primary Examiner*—Paul E. Shapiro

*Attorney, Agent, or Firm*—William L. Fisher

[57] ABSTRACT

A word game for children comprising the combination of a plurality of magnetizable alphabet letters for throwing on a supporting surface to form a pile thereof, a permanent magnet stiff wand having a handle for pulling a desired one or more of the letters from the pile, each letter having a body cut-out into the shape of one of the letters of the alphabet so that, while disposed in the pile, it can be recognized by the sighting of a part thereof, the body of each letter being magnetizable throughout the confines thereof so that, when any part thereof is touched by the wand, the letter can be pulled from the pile, and a plurality of cards for the players to draw respective control cards therefrom, each control card having intelligence printed thereon which requires each player to spell a word with the letters on the card he pulls from the pile, the wand and the pile of magnetizable letters challenging a player's dexterity in being able to sight a desired letter or letters in the pile and to manipulate the wand and to insert same into the pile to pull therefrom only the letter or letters desired and no other letters.

5 Claims, 5 Drawing Figures

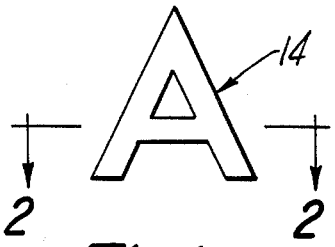
Fig-1
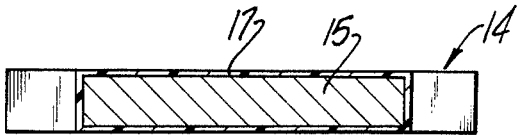
Fig-2
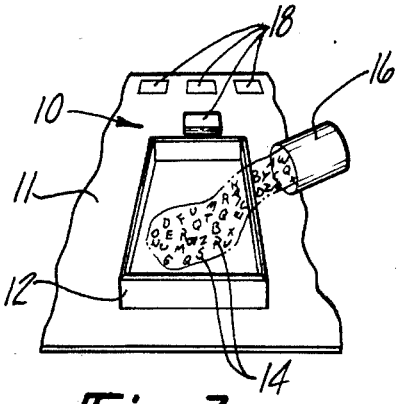
Fig-3
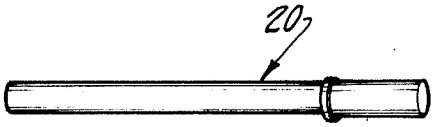
Fig-4
Fig-5
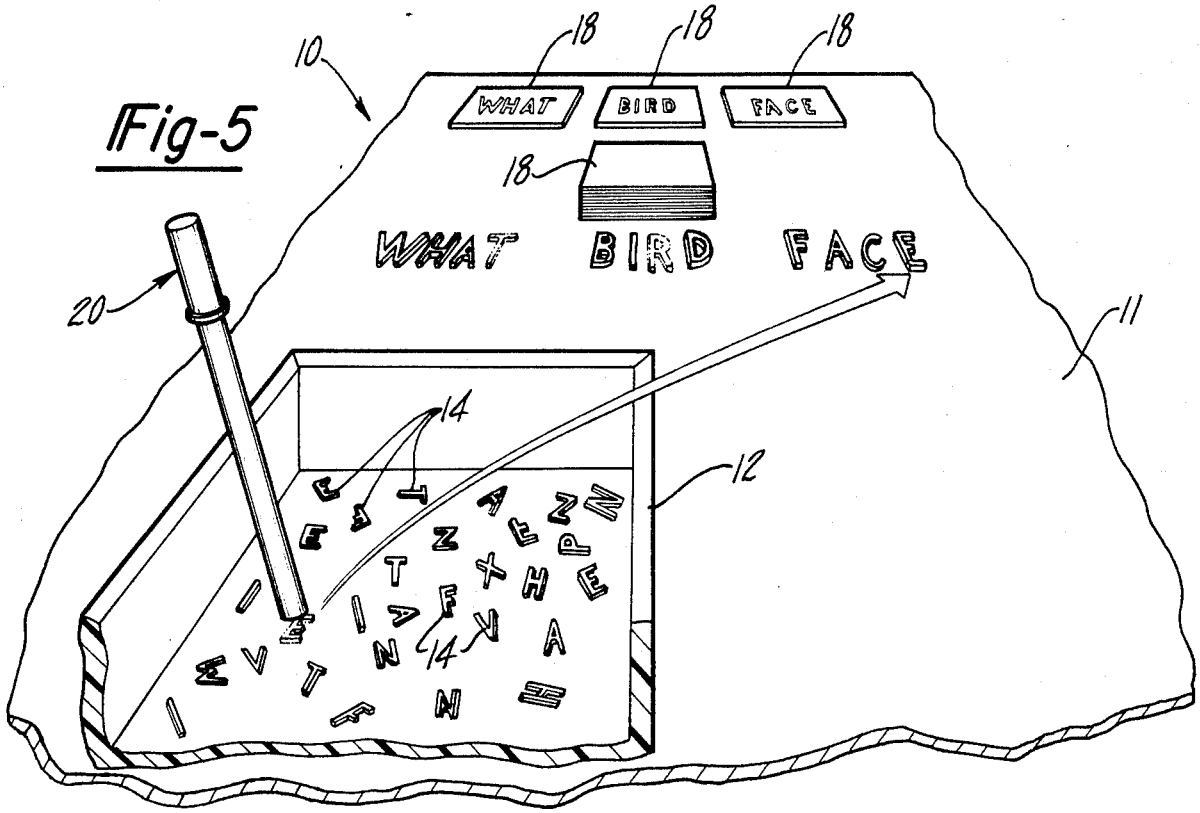

WORD GAME OF MAGNETIZABLE LETTERS FOR CHILDREN

My invention relates to family type table games for children. The principal object of my invention is the provision of a family type table game for children which teaches them skills while holding their interest and eve creating suspense during play of said game.

The foregoing object of my invention, and the advantages thereof, will become apparent during the course of the following description, taken in conjunction with the accompanying drawings, in which:

FIG. 1 is a top plan view of an element of said game;

FIG. 2 is a vertical sectional view of the structure of FIG. 1 taken on the line 2—2 thereof;

FIG. 3 is a perspective view of said game in process of play;

FIG. 4 is a perspective view of another element of said game; and

FIG. 5 is another perspective view of said game in process of play.

Referring to the drawings in greater detail, 10 generally designates said game which I herewith designate Boomer's "MAG-A-Word" as a trademark which term I wish to have used whenever my game is hereafter referred to. Said game 10 uses a surface 11 on which to play and preferably employs a container 12 or other means to provide a confined area of play. Said game 10 comprises a plurality of alphabet letters 14, such as 3 or 4 sets of the consonents and 6 to 10 sets of the vowels. Each letter 14 is formed of a ferrous metal core 15 coated preferably with suitable synthetic resin or plastic 17. Said game 10 also comprises a cup 16 for the letters 14 and three sets of decks of cards, only one of which is shown and designated 18. The cards 18 of the first deck have four letter words printed thereon. Said game 10 also comprises a permanent magnet stiff wand 20 having a handle formed on the rear thereof to pick up one or more of the letters 14.

In use of Boomer's "MAG-A-Word" game, the three sets of cards are used consecutively begining with the first set of four letter word cards 18 as shown. The game 10 is shown in FIGS. 3 and 5 in process of being played by three players who have drawn their respective four letter word "control" cards, i.e. "WHAT";"BIRD" and "FACE", in the instance shown. The object of the game 10 is to be the first player to complete his chosen word and to obtain the highest score. All letters are put into a cup 16 and then are dumped on a flat surface such as in the bottom of the container 12 to form a pile thereof. In FIG. 3 the letters are shown in the process of forming a pile of magnitizable letters 14 in the container 12. The only reason a pile of magnetizable letters 14 is not shown in FIG. 5 is to simplify the task of illustration. The players select their respective four letter cards and then determine by draw, or otherwise, who is to begin play. The beginning player picks up each letter in correct order with the MAG-A-WORD wand to spell his chosen word. Two or more letters may be picked up at one time. If successful, the player is then entitled to an extra turn. If a single letter not part of the chosen word is picked up, the player forefeits his turn. If a letter not part of the chosen word is picked up along with a letter that is part of the chosen work, the player forfeits his turn. Players take turns until a player completes his chosen word. In the instance shown, the player with the word "FACE" is the first to complete his four letter word. At this point in the MAG-A-WORD game, the score is added. Each letter is counted as 10 points. The score is recorded on a MAG-A-WORD score sheet. The second phase of the MAG-A-WORD game now begins with the player having completed the word in the first phase of MAG-A-WORD. The four letter deck is replaced by a five letter deck (not shown) and the game proceeds as in the first phase. Letters are replaced in the proceeds as in the first phase. Letters are replaced in the cup 16 and are again dumped on a flat surface. The second phase of the MAG-A-WORD game is completed when a player completes his respective five letter word. Score is again added at 10 points per letter and recorded on the MAG-A-WORD score sheet. The third phase of the MAG-A-WORD game continues as the first and second phases by replacing the five letter deck with the six letter deck (not shown). When a player completes his chosen six letter word, the game ends with the player having the highest score the MAG-A-WORD winner. The game of MAG-A-WORD is easily cleared away by waving the wand over the letters, which being magnetic, attach themselves to the wand by which they may be carried to the container therefor and dumped therein.

It will thus be seen that there has been provided by my invention a family type table game for children in which the object hereinabove set forth, together with many thoroughly practical advantages, has been successfully achieved. For example, Boomer's MAG-A-WORD game teaches children many skills while holding their interest keenly as play proceeds. In a heavy multi-layered pile of the letters 14, no little dexterity is required to pull therefrom only the letter or letters desired using the wand 20. While a preferred embodiment of my invention has been shown and described, it is to be understood that variations and changes may be resorted to without departing from the spirit of my invention as defined by the appended claims. For example, to aid children in spelling the cards may have printed thereon pictures which require the players to spell the name of the respective picture with the letters 14 drawn from the pile thereof with the aid of the wand 20.

What I claim:

1. A word game for children comprising the combination of a plurality of magnetizable alphabet letters for throwing on a supporting surface to form a pile thereof, a permanent magnet stiff wand having a handle for pulling a desried one or more of said letters from said pile, each letter having a body cut-out into the shape of one of the letters of the alphabet so that, while disposed in said pile, the letter can be recognized by the sighting of a part thereof, the body of each letter being magnetizable throughout the confines thereof so that, when any part thereof is touched by said wand, the letter can be pulled from said pile, and a plurality of cards for the players to draw respective control cards therefrom, each control card having intelligence printed thereon which requires each player to spell a word with the letters on the card he pulls from said pile, said wand and said pile of magnetizable letters challenging a player's dexterity in being able to sight a desired letter or letters in the pile and to manipulate said wand and to insert same into said pile to pull therefrom only the letter or letters desired and no other letters.

2. A word game for children as claimed in claim 1 further comprising container means providing a confined area on which to throw said alphabet letters to form said pile.

3. A word game for children as claimed in claim 1 in which the plurality of cards includes a first deck of cards having different four letter words printed thereon, a second deck of cards having different five letter words printed thereon and a third deck of cards having different six letter words printed thereon.

4. A word game for children as claimed in claim 1 in which each alphabet letter is formed of a coated ferrous metal core.

5. In a word game for children, a method of entertaining children and simultaneously challenging their dexterity, said method using a plurality of cards, a plurality of magnetizable letters, and a permanent magnet stiff wand having a handle, said method inclucing throwing of said letters on a supporting surface to form a pile thereof, each letter having a body cut-out into the shape of one of the letters of the alphabet so that, while disposed in said pile, it can be recognized by the sighting of a part thereof, said method including using said wand for pulling a desired one or more of said letters from said pile, the body of each letter being magnetizable throughout the confines thereof so that when any part thereof is touched by said wand, the letter can be pulled from said pile, said method including the drawing of respective control cards from the plurality of cards, each control card having intelligence printed thereon which required each player to spell a word with the letters on the card he pulls from said pile, said wand and said pile of magnetizable letters challenging a player's dexterity in being able to sight a desired letter or letters in the pile and to manipulate said wand and insert same into said pile to pull therefrom only the letter or letters desired and no other letters.

* * * * *